US008720862B2

(12) United States Patent
Ernest et al.

(10) Patent No.: US 8,720,862 B2
(45) Date of Patent: May 13, 2014

(54) TRASH CAN LIFTING DEVICE WITH LEVER

(76) Inventors: Gretchen Elizabeth Ernest, Savannah, GA (US); Thomas Matthew Hoffmam, Savannah, GA (US)

( * ) Notice: Subject to any disclaimer, the term of this patent is extended or adjusted under 35 U.S.C. 154(b) by 328 days.

(21) Appl. No.: 13/081,624

(22) Filed: Apr. 7, 2011

(65) Prior Publication Data

US 2011/0248226 A1 Oct. 13, 2011

Related U.S. Application Data

(60) Provisional application No. 61/321,855, filed on Apr. 7, 2010.

(51) Int. Cl.
*B66F 3/00* (2006.01)
*B65D 43/26* (2006.01)

(52) U.S. Cl.
USPC ..... 254/113; 220/263; 220/264

(58) Field of Classification Search
USPC ..... 254/113, 134, 8 C, 10 R, 10 B, 10 C
See application file for complete search history.

(56) References Cited

U.S. PATENT DOCUMENTS

| | | | | |
|---|---|---|---|---|
| 7,165,795 | B2 * | 1/2007 | Williams | 294/16 |
| 8,136,688 | B2 * | 3/2012 | Lee et al. | 220/262 |
| 2004/0004080 | A1 * | 1/2004 | Yang et al. | 220/263 |

* cited by examiner

*Primary Examiner* — Lee D Wilson
*Assistant Examiner* — Seahee Yoon

(57) ABSTRACT

The apparatus is to assist in the removal of trash receptacles and or bag liners from under counter single, double, or multiple slide-out trash can cabinets. By stepping on the lever located below the trash can, the trash-can will be raised approximately one inch which will allow a person to remove the plastic trash bag (bag liner) from the rim of the trash can. It will also allow easy removal of the trash receptacle itself once it is raised by allowing a person to grasp the rim of the trash can. The unit can be retrofitted onto existing pull-out trash can cabinets or mounted in new.

10 Claims, 6 Drawing Sheets

FRONT VIEW
TRASH CAN IN LOWER POSITION

FRONT VIEW
TRASH CAN IN LOWER POSITION

FRONT VIEW
TRASH CAN IN LIFTED POSITION

TOP VIEW
TRASH CAN IN LOWER POSITION
CABINET DRAWER CLOSED

TOP VIEW
TRASH CAN IN LIFTED POSITION
CABINET DRAWER OPEN

SIDE VIEW
TRASH CAN IN LOWER POSITION
CABINET DRAWER CLOSED

SIDE VIEW
TRASH CAN IN LIFTED POSITION
CABINET DRAWER OPEN

TRASH CAN LIFTING DEVICE WITH LEVER

This application claims the benefit and right of priority to the previously filed provisional application No. 61/321,855 titled "Trash Can Lifting Devise With Lever," which is hereby incorporated by reference.

BACKGROUND OF INVENTION

Various conventional trash receptacles involving pedals are known in the art. For example, U.S. Pat. No. 5,163,579 entitled "Trash Receptacle with Retractable Foot Pedal" provides for a trash receptacle with a pedal pivotally mounted on one end at the bottom of a recessed area. Pressure on the pedal moves it to a lowered substantially horizontal position for holding the trash receptacle down by foot pressure while removing a bag liner.

U.S. Pat. No. RE 30,875 entitled "Foot Operated Container and Closure Devise" provides a receptacle having an open end, a closure or lid detachably and pivotally mounted on the open end of the container and an operating member connected to the closure so that the closure can be raised to and from a closed position in response to operation of an operating member.

U.S. Pat. No. 4,972,966 entitled "Step on Wastebasket" provides a wastebasket with a cover that is opened by one actuation of a foot pedal and which remains open until another actuation of the foot pedal closes the wastebasket.

U.S. Pat. No. 4,785,964 entitled "Step-on Wastebasket" provides a container having a top opening, and a lid mounted on the container and adapted to pivot about a pivot axis to cover and uncover the top opening. A mechanism for actuating pivotal movement of the lid with respect to the container is provided. The mechanism includes a generally horizontal operating lever having a foot pedal.

U.S. Pat. No. 4,763,809 entitled "Waste Container and Adjustable Bag Linear Package Holder Combination" provides a rigid container and bottom skirt with an adjustable pawl arm at the bottom that extends through the skirt. It is provided with a vertical member to hold a supply package of linear bags between the vertical member and the container.

U.S. Pat. No. 4,763,809 entitled "Refuse Container caddy Apparatus" provides an overlying support tray that secures a plurality of polygonal refuse containers in an underlying second support tray. The overlying refuse containers are secured utilizing opposed pivoted latch members wherein the underlying second support tray utilizes an upwardly extending "T" shaped connector with a plate positioned within a cavity of the circular cross-sectional containers.

No conventional trash receptacles are specifically related to the removal of a trash liner from the rim of a receptacle in which that activity may or may not occur in conjunction with the removal of the receptacle from a holding frame.

SUMMARY OF THE PRESENT INVENTION

Various embodiments of the present disclosure are directed to a device that assists in the removal of trash receptacles and/or bag liners from under counter single, double, or multiple slide-out trash can cabinets. By stepping on a lever of the device, located below the trash can, the trash-can is raised approximately one inch, allowing the operator to remove the plastic trash bag (bag liner) from the rim of the trash can. It enables easy removal of the trash receptacle itself once it is raised by allowing the operator to easily grasp the rim of the trash can. The device may be retrofitted onto existing pull-out trash can cabinets or mounted in new.

BRIEF DESCRIPTION OF THE DRAWINGS

For a further understanding of the nature and objects of the present invention, reference should be made to the following description taken in conjunction with the accompanying drawing in which like parts are given like reference numerals and, wherein.

DETAILED DESCRIPTION

Various embodiments are is generally related to a trash receptacle(s) in which it is desired that the receptacle(s) be removed from a holding frame and or a bag liner removed from the rim of the receptacle, and more particularly having a pedal to lift the receptacle from the holding frame. The pedal lifting devise will assist in the removal of a trash receptacle from a holding frame and or trash can liner from the rim of a receptacle.

The components are easily dissembled and can be installed on an existing holding frame or incorporated into a newly constructed frame.

Figure 1:
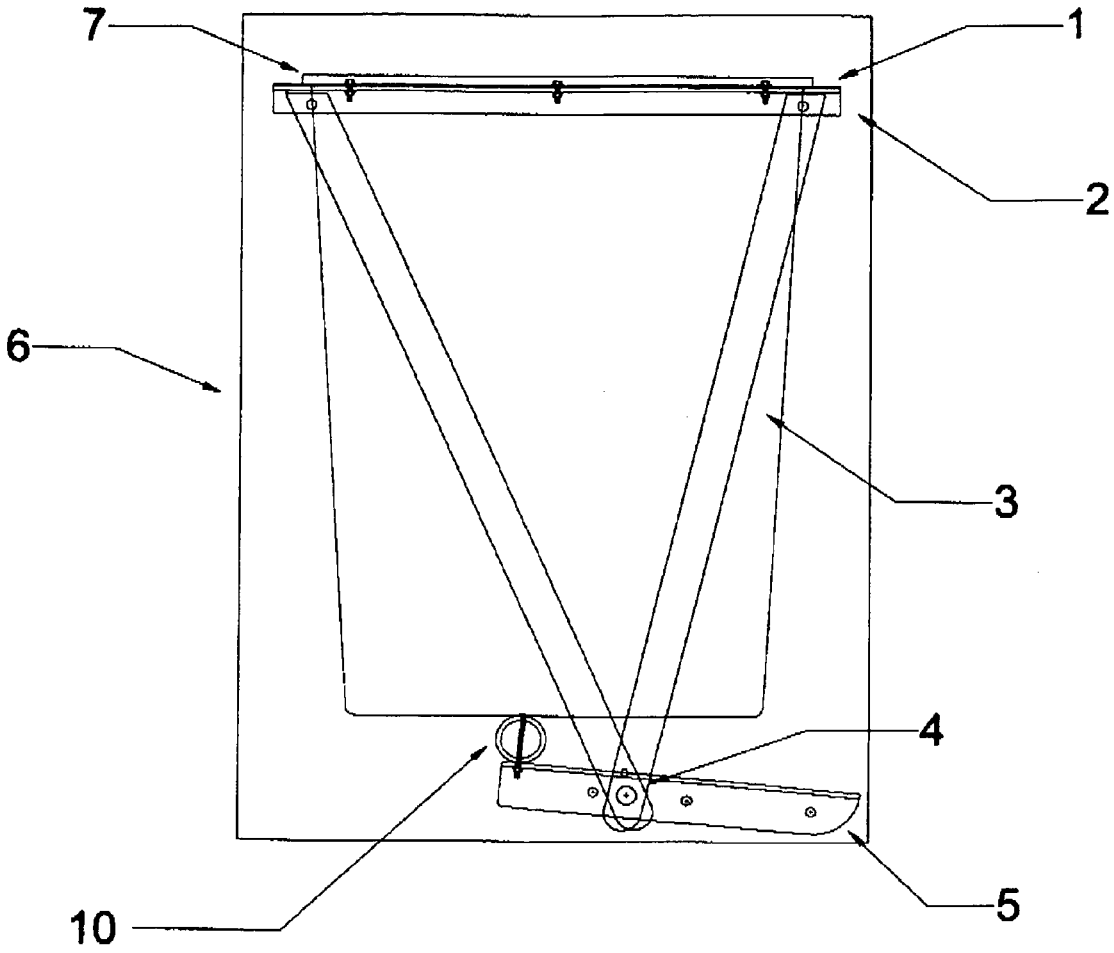
FIG. 1 is a schematic diagram showing a front view of a trash can lifting device with the trash can in lower position, according to a representative embodiment.
Figure 2:
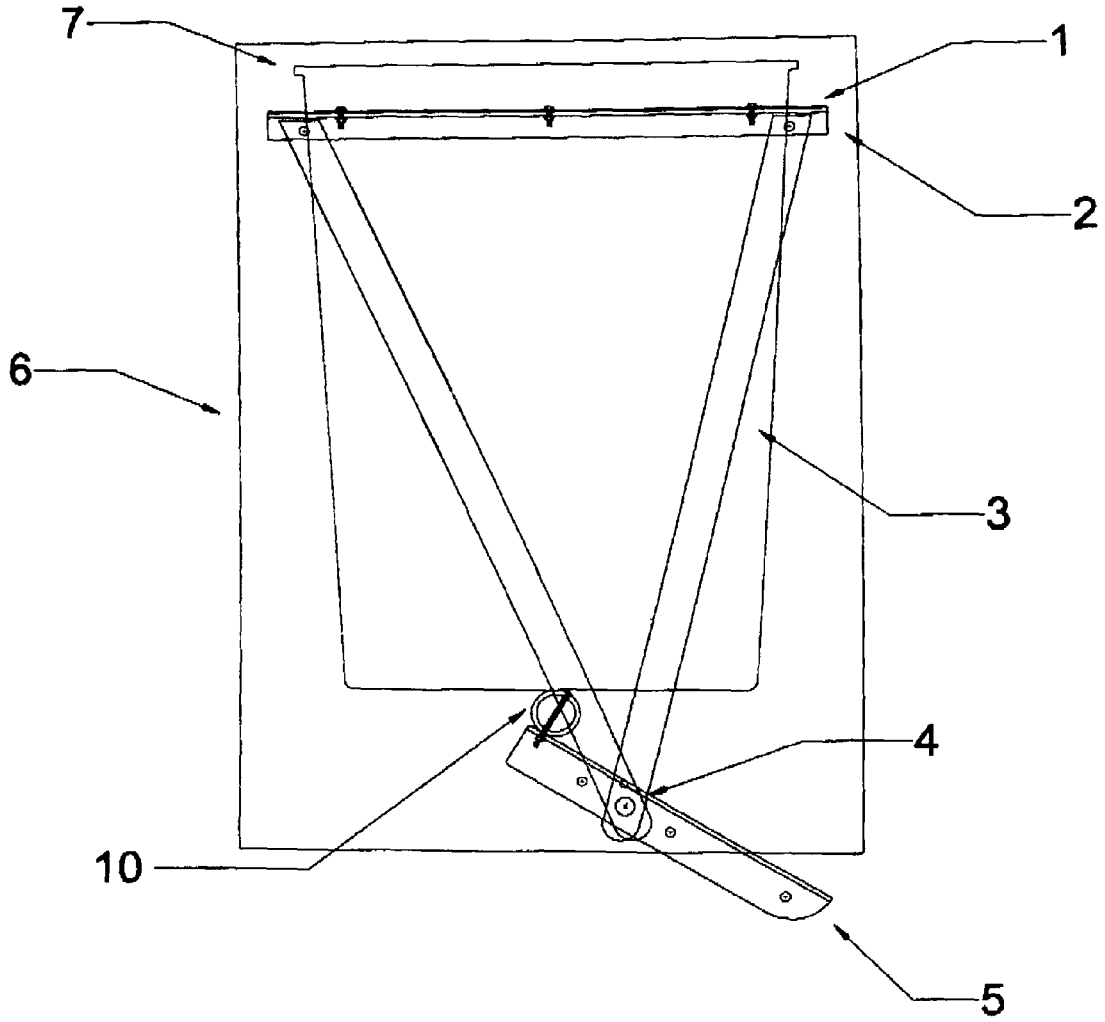
FIG. 2 is a schematic diagram showing a front view of a trash can lifting device with the trash can in lifted position, according to a representative embodiment.

FIGS. 1 and 2 are schematic diagrams showing a front view of a trash can lifting device with the trash can in lower and lifted positions, respectively, according to a representative embodiment. Referring to FIG. 1, holding frame 1 is configured to hold trash can 7 within cabinet frame 6. The trash can 7 may be an 18 inch deep trash can, for example, although other sizes may be incorporated. V-shaped truss 3 is connected to angle section 2, which is fastened to the holding frame 1. The angle section 2 may be formed of aluminum, for example, with thickness dimensions of about 1.25 inches× 1.25 inches×0.125 inches, and a length of about 15 inches. Also, the V-shaped truss 3 includes multiple truss supports, each of which may be about 1 inch wide by about 0.125 inch thick, for example. Of course, the angle section 2 and the V-shaped truss 3 may be formed of any other suitable material, such as steel, carbon fiber, fiber glass, plastic, etc., and various sizes, without departing from the scope of the present teachings. Likewise, the V-shaped truss 3 may be attached to the holding frame 1 via means other than the angle section 2.

The multiple truss supports of the V-shaped truss 3 are connected at the apex of the V-shaped truss 3 by horizontal cross support or axle 4, which may have a diameter of about ½ inch and may be formed of steel or aluminum, for example, or other suitable material. Lever 5 is rotatably connected to the V-shaped truss 3 via the axle 4, enabling the trash can 7 to be lifted and lowered in response to the lever 5 being depressed (FIG. 2) and released (FIG. 1), respectively. That is, the lever 5 has an exposed first end and configured to move in a downward direction in response to an externally applied force, such as down pressure of the operator's foot. The lever 5 further includes an opposite second end configured to move in an upward direction in response to the downward movement of the first end, which lifts the trash can 7 above the holding frame 1 by contacting a bottom surface of the trash can 6. in an embodiment, a lever extension 10 (e.g., a tube or pipe) is attached to the second end of the lever 5 and configured to slide along the bottom of the trash can 7 during the lifting and lowering motions.

Figure 3:
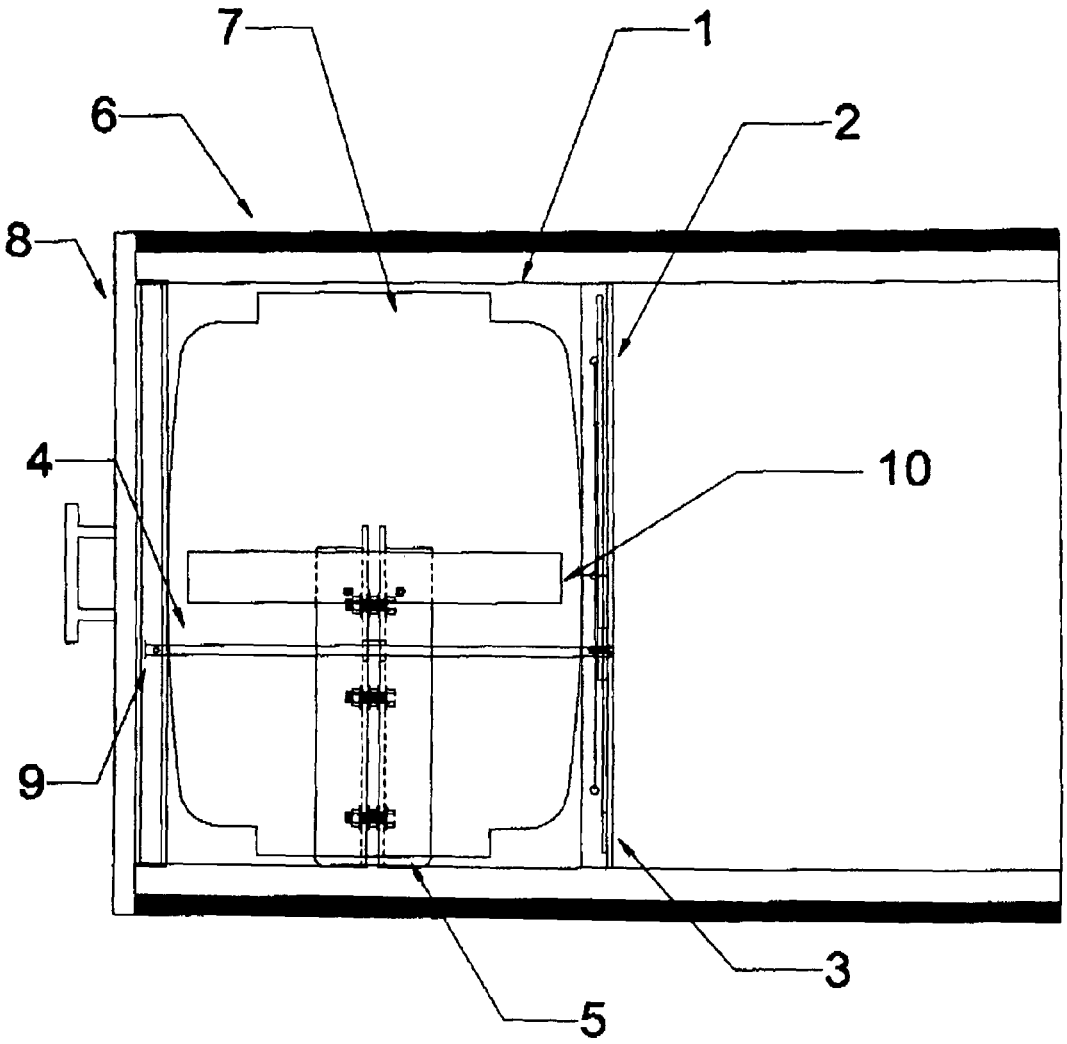
FIG. 3 is a schematic diagram showing a top view of a trash can lifting device with the trash can in lower position, cabinet drawer closed, according to a representative embodiment.
Figure 4:
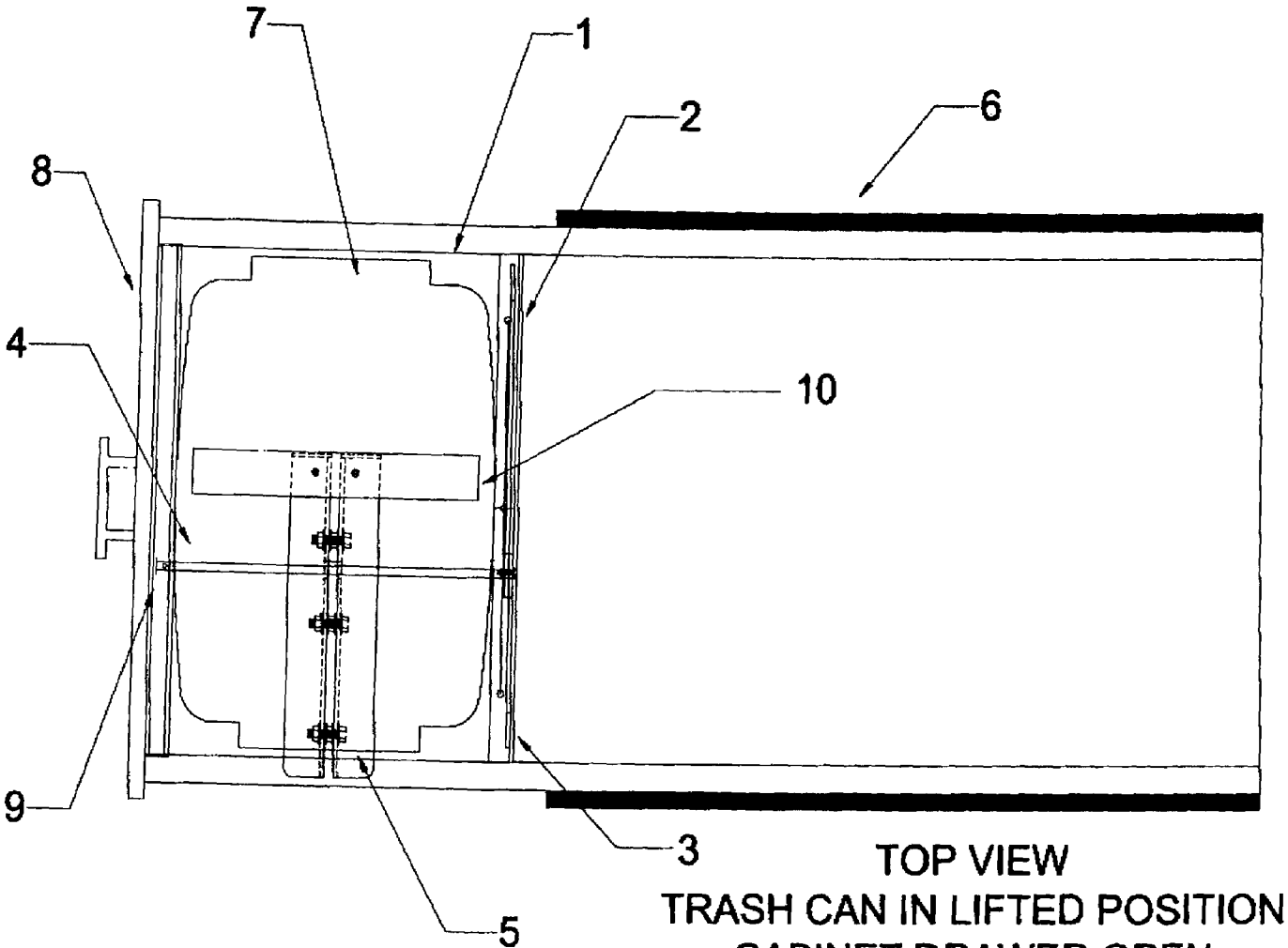
FIG. 4 is a schematic diagram showing top view of a trash can lifting device with the trash can in lifted position, cabinet drawer open, according to a representative embodiment.

FIGS. 3 and 4 are schematic diagrams showing a top view of a trash can lifting device with the trash can 7 in lower and lifted positions, respectively, according to a representative embodiment. In both FIGS. 3 and 4, the trash can 7 is omitted for clarity to show the lifting device. Referring to FIG. 3, holding frame 1 is configured to hold trash can 7 within cabinet frame 6 and is indicating a closed position of cabinet door 8 with the trash can in lower position. Referring to FIG. 4, holding frame 1 is configured to hold trash can 7 within cabinet frame 6 and is indicating an opened position of cabinet door 8 with the trash can in lifted position. When the cabinet door 8 is in the opened position, the lifting device and trash can 7 may be pulled out from the cabinet.

Figure 5:
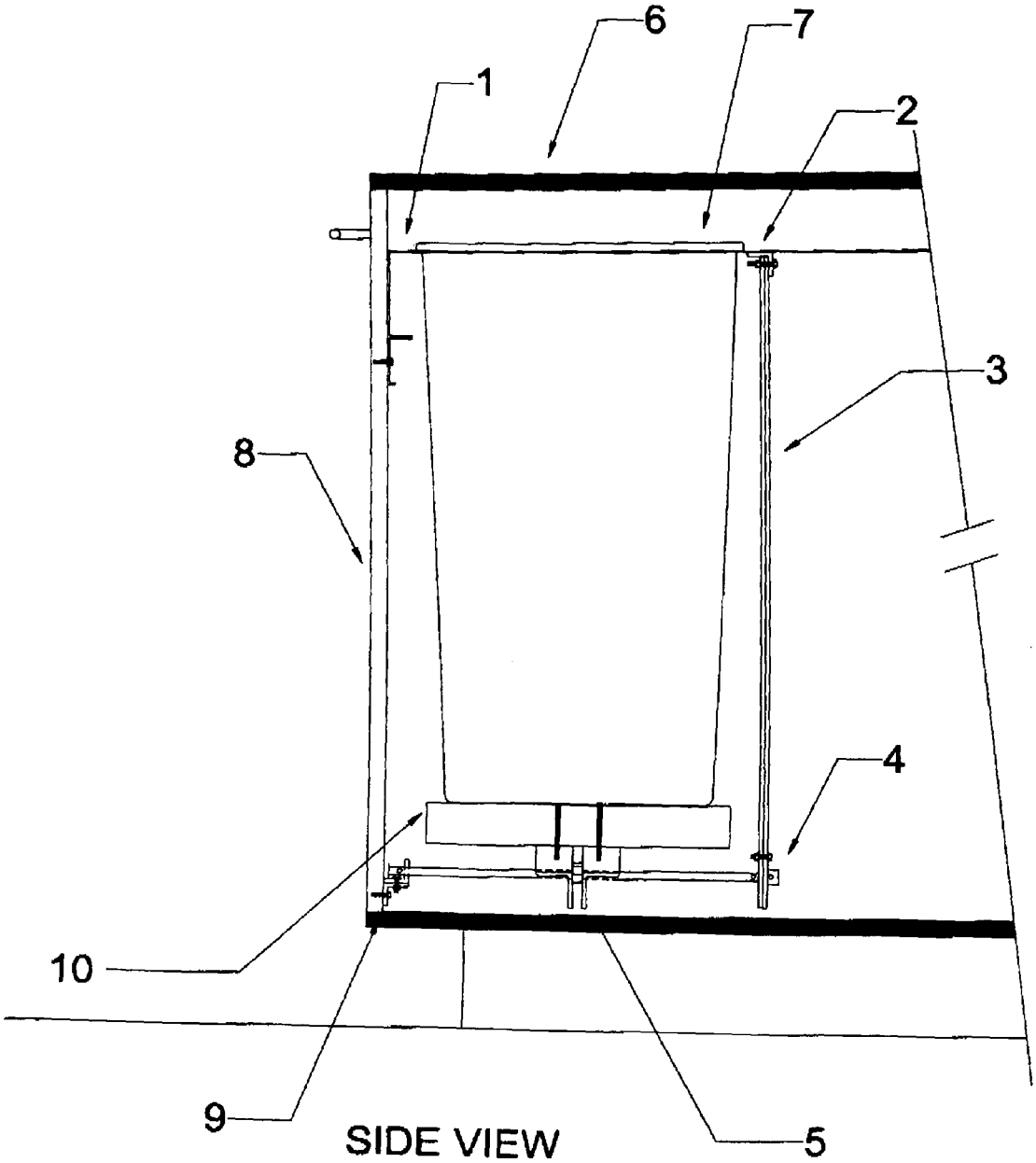
FIG. 5 is a schematic diagram showing a side view of a trash can lifting device with the trash can in lower position, according to a representative embodiment.
Figure 6:
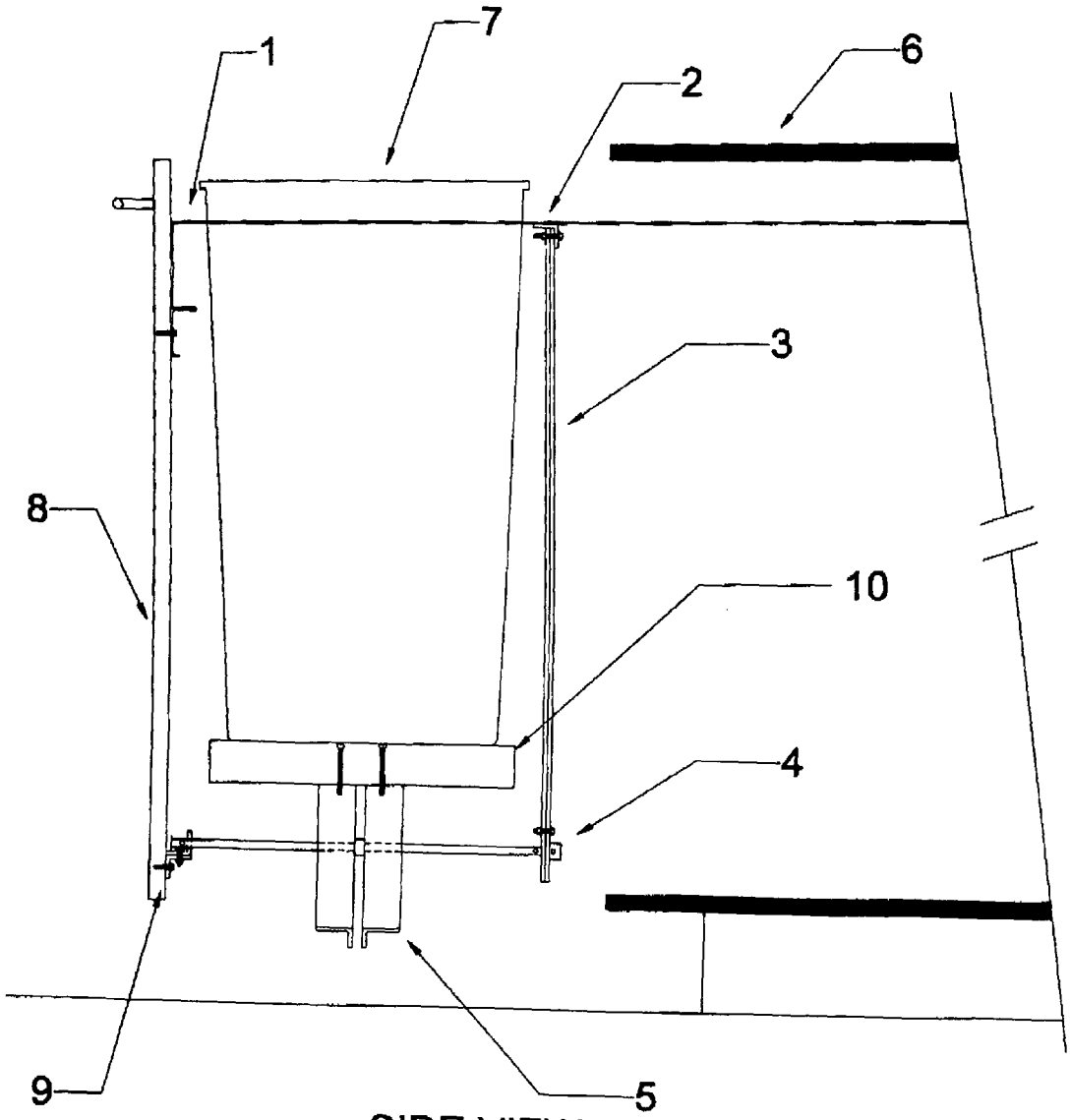
FIG. 6 is a schematic diagram showing side view of a trash can lifting device with the trash can in lifted position, according to a representative embodiment.

FIGS. 5 and 6 are schematic diagrams showing a side view of a trash can lifting device with the trash can in lower and lifted positions, respectively, according to a representative embodiment. Referring to FIG. 5, holding frame 1 is configured to hold trash can 7 within the cabinet frame 6 and is indicating a closed position of the cabinet door 8 with the trash can 7 in lower position. Referring to FIG. 6, holding frame 1 is configured to hold trash can 7 within the cabinet frame 6 and is indicating an opened position of the cabinet door 8 with the trash can in lifted position. FIGS. 5 and 6 also show cabinet door bracket 9 for holding axle 4. The cabinet door bracket 9 may include two one inch long angle sections, about 1.25"×1.25"×0.125" thick fastened to cabinet door to support ends of axle 4. Of course, in alternative configurations, the cabinet door bracket 9 may be various sizes and shapes, or alternative means may be incorporated to support the axle 4, without departing from the scope of the present teachings.

While specific embodiments are disclosed, it is understood that many variations are possible, which remain within the concept and scope of the present disclosure.

The invention claimed is:

1. A device for lifting a trash can from a holding frame, the device comprising:

a V-shaped truss comprising a plurality of truss supports connected to opposing sides of the holding frame:

a horizontal cross support connecting the plurality of truss supports at a vertex of the V-shaped truss; and a lever rotatably connected to the horizontal cross support, the lever comprising an exposed first end configured to move in a downward direction in response to an externally applied force, and an opposite second end configured to move in an upward direction in response to the downward movement of the first end, the movement of the second end in the upward direction lifting the trash can above the holding frame by contacting a bottom surface of the trash can.

2. The device of claim 1, wherein the lever is foot operated, such that the externally applied force in the downward direction is applied by an operator's foot.

3. The device of claim 1, further comprising:

a lever extension attached to the second end of the lever and configured to slide along the bottom of the trash can while the second end is lifting the trash can.

4. The device of claim 1, wherein the first end is further configured to move in the upward direction in response to removal of the externally applied force, and the opposite second end is configured to move in the downward direction in response to the upward movement of the first end, the movement of the second end in the downward direction allowing the trash can to return to the holding frame.

5. A device comprising:

a holding frame connectable to a cabinet frame, the holding frame being configured to hold a trash can;

a V-shaped truss connected to the holding frame, the V-shaped truss comprising a plurality of truss supports connected at a vertex by an axle; and a lever connected to the axle and comprising first and second ends, wherein application of a downward force on the first end causes upward movement of the second end, lifting the trash can from the holding frame via a bottom surface of the trash can.

6. The device of claim 5, further comprising:

a lever extension attached to the second end of the lever and configured to slide along the bottom of the trash can while the second end is lifting the trash can.

7. The device of claim 5, wherein removal of the downward force on the first end causes downward movement of the second end, allowing the trash can to return to the holding frame.

8. The device of claim 5, further comprising:

an angle section configured to connect the V-shaped truss to the holding frame.

9. The device of claim 8, wherein the axle is connected between the vertex of the V-shaped truss and a cabinet door.

10. A device comprising:

a holding frame configured to hold a trash can, and connectable between a cabinet frame and a cabinet door so that the trash can is removable from within the cabinet frame when the cabinet door is in an open position;

a V-shaped truss connected to the holding frame by an angle section, the V-shaped truss comprising truss supports connected at a vertex;

an axle connected between the vertex of the V-shaped truss and the cabinet door; and a lever connected to the axle and comprising first and second ends, wherein application of a downward force on the first end causes upward movement of the second end, lifting the trash can from the holding frame via a bottom surface of the trash can.

* * * * *